United States Patent [19]

Chusha

[11] 4,041,427

[45] Aug. 9, 1977

[54] REED SWITCHING OPENING AND CLOSING DEVICE

[75] Inventor: Hideo Chusha, Mobara, Japan

[73] Assignee: Futaba Denshi Kogyo K. K., Japan

[21] Appl. No.: 620,176

[22] Filed: Oct. 6, 1975

[30] Foreign Application Priority Data

Apr. 15, 1975 Japan ..... 50-44779

[51] Int. Cl.[2] ..... H01H 36/00

[52] U.S. Cl. ..... 335/205; 335/151

[58] Field of Search ..... 335/151, 154, 205, 206, 335/207, 153

[56] References Cited

U.S. PATENT DOCUMENTS

| | | | |
|---|---|---|---|
| 3,418,610 | 12/1968 | Hammond | 335/206 X |
| 3,510,813 | 5/1970 | Bozzone | 335/206 X |
| 3,594,669 | 7/1971 | Yamane et al. | 335/207 |
| 3,636,485 | 1/1972 | Weathers | 335/207 X |
| 3,760,312 | 9/1973 | Shlesinger | 335/206 |
| 3,921,108 | 11/1975 | O'Connor | 335/153 |

FOREIGN PATENT DOCUMENTS

| | | | |
|---|---|---|---|
| 429,942 | 8/1967 | Switzerland | 335/207 |

*Primary Examiner*—Harold Broome
*Attorney, Agent, or Firm*—Oblon, Fisher, Spivak, McClelland & Maier

[57] ABSTRACT

A reed switch opening and closing device comprises a reed switch having a pair of reeds with a contact therebetween operated by a change of magnetic flux. A magnet having N and S poles is movably disposed relative to and adjacent to the reed switch. The magnet is disposed so that the N-S direction thereof is oblique to the longitudinal direction of the reeds of the reed switch.

5 Claims, 12 Drawing Figures

REED SWITCHING OPENING AND CLOSING DEVICE

BACKGROUND OF THE INVENTION

1. Field of the Invention

This invention relates to a device for opening and closing a reed switch. The device has a reed switch operated by a change of magnetic flux and a magnet means for operating the reed switch movably disposed relative to and adjacent to the reed switch.

2. Description of the Prior Art

In the conventional device for opening and closing a reed switch, a sensitive operation which can be put into practical use cannot be expected where one reed switch is opened and closed by using one magnet means composed of one magnet having N and S poles. The reasons this is so are as follows:

As will later be described in detail with reference to the drawings, the periphery of the magnetic force area of the magnet means is unstable and therefore the working distance of the magnet means must be rather large in order to satisfactorily operate the reed switch. On the other hand, the working distance of the magnet means is required to be as short as possible for operational reasons. Generally it has been difficult to simultaneously satisfy the above two contradictory conditions.

In order to overcome such disadvantages of the above-mentioned type device, it has been attempted to realize a sensitive operation of the reed switch, for example, by variously arranging three poles (N,S,N) or four poles (N,S,N,S) of magnets to thereby change the distribution of the magnetic flux or the direction of a part of the lines of magnetic force. However, such a device having magnet means composed of a combination of three or four poles of magnets and one reed switch operated by the magnet means is very complicated in construction. It also has the disadvantage that, due to the mutual interference of the lines of magnetic force, unstable factors are increased which has the possibility of deteriorating the sensitive opening and closing operations of the reed switch. In cases where a number of such devices are arranged in parallel as in the case of an electronic computer, the above-mentioned unfavorable characteristics can be quite detrimental.

SUMMARY OF THE INVENTION

It is therefore an object of the present invention to provide a reed switch opening and closing device which is simple and compact in construction and is sensitive and accurate in operation.

It is another object of the present invention to provide a reed switch opening and closing device which comprises a reed switch having a contact opened and closed by the change of magnetic flux and a magnet means composed of one permanent magnet having N and S poles for magnetically opening and closing the contact of the reed switch in a sensitive manner.

It is a further object of the present invention to provide a device for opening and closing a reed switch which can decrease the moving distance of the magnet means by obliquely moving the magnet means relative to the reed switch.

It is still another object of the present invention to provide a reed switch opening and closing device which can eliminate the mutual interference of the lines of magnetic force in a conventional device having three or four poles of magnets.

The foregoing and other objects are attained in accordance with one aspect of the present invention through the provision of a reed switch opening and closing device which comprises a reed switch having a pair of reeds with a contact opened and closed by the change of magnetic flux and magnet means for operating the reed switch comprised of one permanent magnet having N and S poles movably disposed relative to and adjacent to the reed switch. The magnet means is disposed adjacent to the reed switch so that the N-S direction thereof is positioned obliquely to the longitudinal direction of the reeds of the reed switch so that relative movement between the reed switch and the magnet means positions both reeds in the magnetic force area and thereby magnetizes both reeds.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which.

DETAILED DESCRIPTION OF THE PREFERRED EMBODIMENTS

Figure 1A:
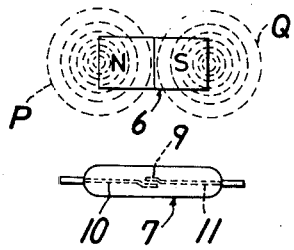
FIG.1(a) PRIOR ART
FIGS. 1 (*a*) and 1 (*b*) are, respectively, a front view and a side sectional view of a conventional device for opening and closing a reed switch showing its opened state.

Reference will now be made to the drawings wherein like reference numerals designate identical or corresponding parts throughout the several views.

Figure 2A:
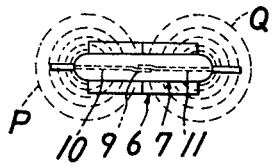
FIG.2(a) PRIOR ART
FIGS. 2 (*a*) and 2 (*b*) are, respectively, a front view and a side sectional view of a conventional device for opening and closing a reed switch showing its closed state.
Figure 1B:
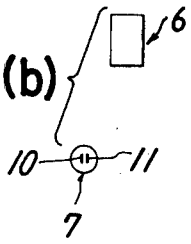
Figure 2B:
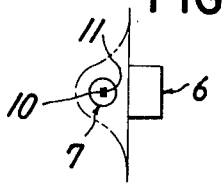

Before describing the present invention, it will be helpful to describe the features of a conventional device in detail in conjunction with FIGS. 1 and 2.

As shown in FIGS. 1 (*a*), 1 (*b*), 2 (*a*) and 2 (*b*), a magnet means 6 and a reed switch 7 are disposed adjacent to each other so that the N-S direction of the magnet means 6 and the longitudinal direction of the reed switch 7 are horizontal. Usually, the magnet means 6 is vertically moved to operate the reed swtich 7. When the magnet means 6 approaches the reed switch 7, two reeds 10 and 11 of the reed switch 7 are temporarily magnetized to S and N poles, respectively, under the influence of the magnetic field of the magnet means 6. Thus, a contact 9 formed between the reeds 10 and 11 is closed by the action of the attraction created between the two reeds 10 and 11. When the magnet means 6 is separated from the reed switch and the reeds 10 and 11 are thereby demagnetized, the contact 9 of the reed switch 7 is opened by the action of the resilient force of the reeds 10 and 11. In this instance, magnetic force areas P and Q of the N and S poles of the magnet means 6 extend far away from the upper and lower end surfaces of the magnet means 6 and, therefore, the magnetic field of the magnet means 6 becomes unstable in the vicinity of the peripheral area thereof. In addition, residual magnetism will exist in the reed switch 7. Thus, the above-mentioned peripheral unstable magnetic field of the magnet means 6 and the residual magnetism in the reed switch will result in an unexpectedly large relative moving distance of the magnet means 6 for achieving satisfactory opening and closing operation of the reed switch 7. On the other hand, the moving distance of the magnet means 6 must be as short as possible for operational reasons. Generally, it has been difficult to simultaneously satisfy the above two contradictory conditions.

The present invention will now be described in detail in conjunction with the drawings.

Figure 3:
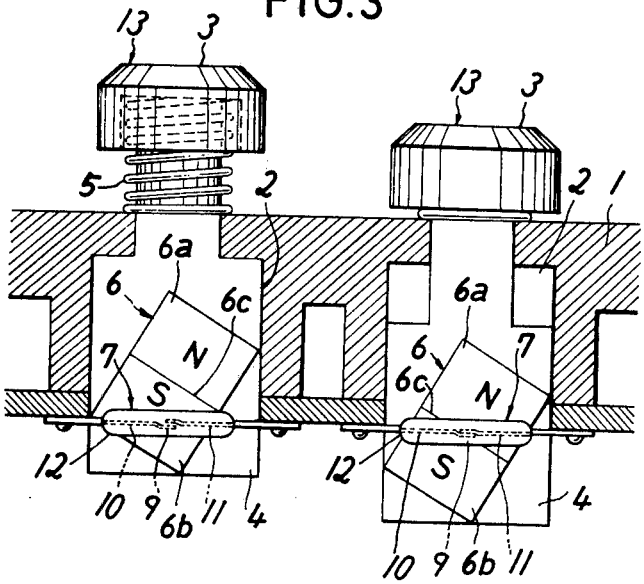
FIG. 3 is a longitudinal sectional view of a device for opening and closing a reed switch according to one embodiment of the present invention.
Figure 4A:
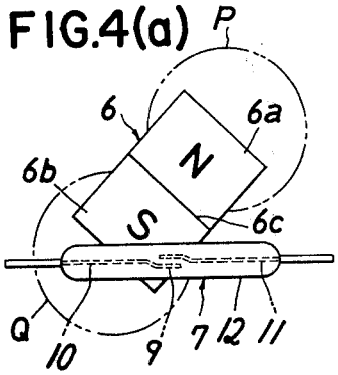
FIGS. 4 (*a*) and 4 (*b*) are enlarged elevational views of an essential part of the device of FIG. 3 according to the present invention showing its operation.
Figure 4B:
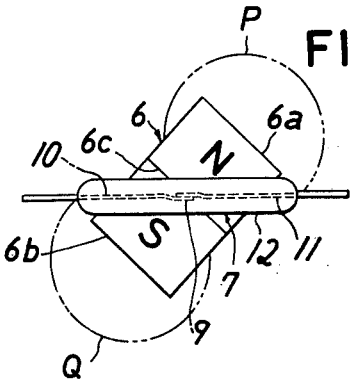

First, reference is made to FIGS. 3, 4 (*a*) and 4 (*b*) which show one embodiment of a device according to the present invention.

Numeral 1 illustrates a keyboard which has a plurality of switch chambers 2. Each of the switch chambers 2 has a key stem 4 of a key 13 vertically slidably inserted thereinto and a return spring 5 interposed between the lower surface of a key top 3 of the key 13 and the upper surface of the keyboard 1.

Numeral 6 is a magnet means composed of a simple block-shaped permanent magnet having a pair of identically-shaped N and S pole blocks 6*a* and 6*b* magnetically bonded to each other. The magnet means 6 is fixed to the front wall surface of the key stem 4 of the key 13. In the above fixed condition, this magnet means 6 is disposed with the N pole block 6*a* thereof at the top side and with the N-S direction thereof oblique to the longitudinal direction of the keyboard 1, for example, approximately 10° to 80°, preferably about 45° with respect to the horizontal direction. Accordingly, a boundary line 6*c* of both pole blocks 6*a* and 6*b* of the magnet means 6, which line is at a right angle to the N-S direction of the magnet means 6, is also obliquely disposed with respect to the N-S direction of the magnet means 6.

Numeral 7 shows a reed switch which has a sealed cylindrical housing 12. A pair of reeds 10 and 11 composed of elastic wires of magnetic metal are provided along the central axis of the cylindrical housing 12. The free ends of these reeds 10 and 11 are normally separated in a superimposed manner and the fixed ends thereof are extended externally through the opposite ends of the cylindrical housing 12. The externally extended portions of both reeds 10 and 11 are connected and fixed to the right and left printed boards at the open bottom of each switch chamber 2. Thus, the reed switch 7 is so fixed that both reeds 10 and 11 are horizontal. In addition to the above-mentioned construction, the reed switch 7 is provided adjacent to the front surface of the magnet means 6. As shown in the left part of FIG. 3, if the key 13 moves upwardly to position the boundary line 6*c* of the magnet means 6 above the reed switch 7, both the reeds 10 and 11 are placed within the magnetic force area Q of the S pole 6*b* of the magnet means 6. On the other hand, as shown in the right part of FIG. 3, if the key 13 moves downwardly to make the contact 9 of the reed switch 7 align with the central part of the central axis of the N-S direction or the boundary line 6*c* of the magnet means 6 in a cross manner (when viewed from the front of the reed switch 7), the reeds 10 and 11 become positioned within different magnetic force areas P and Q, respectively.

As shown in FIGS. 3 and 4 (*a*), the key 13 normally assumes the upward position by the action of the spring 5 interposed between the lower surface of the key top 3 of the key 13 and the upper surface of the keyboard 1. Therefore, both reeds 10 and 11 are positioned near and opposite to the S pole block 6*b* of the magnet means 6 and thus, are placed in the same magnetic force area Q of the S pole. As a result, the contact 9 of the reed switch 7 is opened and accordingly the reed switch assumes the electrical "OFF" state. In this state, as shown in FIGS. 3 and 4 (*b*), if the key 13 is depressed to make the contact 9 of the reed switch 7 align with the central part of the central axis of the N-S direction or the boundary line 6*c* of the magnet means 6 in a cross manner (when viewed from the front of the reed switch 7), one reed 10 of the reed switch 7 is left in the magnetic force area Q of the S pole while the other reed 11 thereof is moved into the magnetic force area P of the N pole. As a result, the respective reeds 10 and 11 assume different polarities and are thereby attracted to each other so that the contact 9 of the reed switch 7 is closed. Accordingly, the reed switch assumes the electrical "ON" state.

When the key 13 is released, it is moved upwardly by the action of the spring 5 interposed between the lower surface of the key top 3 of the key 13 and the upper surface of the keyboard 1 and both the reeds 10 and 11 approach the S pole 6*b* of the magnet means 6 and are positioned in the same magnetic force area Q of the S pole. Accordingly, the contact 9 of the reed switch 7 is opened and the electrical OFF state is assumed.

Therefore, the aforementioned ON and OFF operation of the reed switch 7 can be performed only by the upward and downward movements of the key 13 whose distance corresponds to the length of a leg of a right angle triangle formed with half of the boundary line 6*c* as a hypotenuse. Accordingly, the depressing distance of the key 13 is very short compared with that of a conventional reed switch. In the OFF operation of the reed switch, both the reeds 10 and 11 are positioned in the same magnetic force area. Therefore, the peripheral influences of both poles 6*a* and 6*b* of the magnet means 6 with respect to the reeds 10 and 11 can be eliminated to insure an accurate OFF operation.

Figure 5:
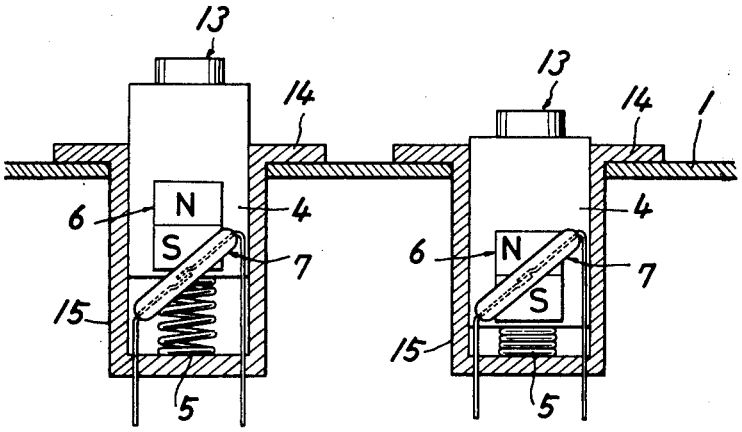
FIG. 5 is a longitudinal sectional view of a device for opening and closing a reed switch of another embodiment of the present invention.
Figure 6A:
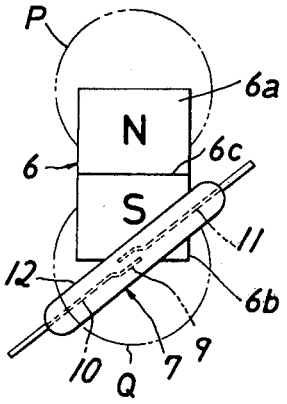
FIGS. 6(*a*) and 6(*b*) are enlarged elevational views of an essential part of the device of FIG. 5 according to the present invention showing its operation.
Figure 6B:
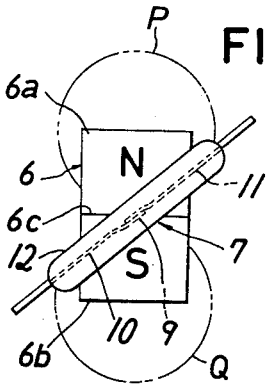
Figure 7A:
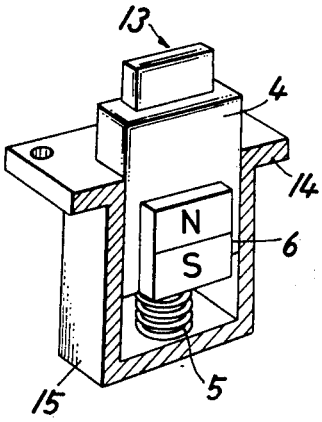
FIGS. 7 (*a*) and 7 (*b*) are prespective views of the split halves of a switch housing of the device of FIG. 5 according to the present invention.
Figure 7B:
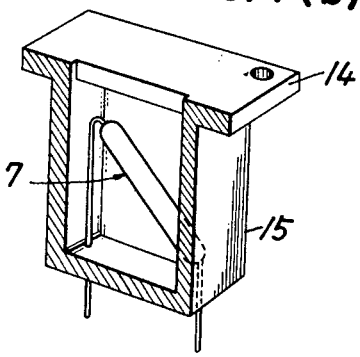

In FIGS. 5 to 7 (*b*), which show another embodiment of the device for opening and closing a reed switch of the present invention, the magnet means 6 is designed so that the N-S direction thereof is vertical and, accordingly, the boundary line 6*c* thereof is horizontal. The reed switch 7 is designed so that the reeds 10 and 11 are obliquely disposed with respect to the longitudinal direction of the keyboard 1, for example, approximately 10° to 80°, preferably about 45° with respect to the horizontal direction. In addition, the device is entirely independently contained in a recessed switch housing 15 disposed in the upper surface of the keyboard 1 through a flange 14 formed at the upper edge of the switch housing 15. The reed switch 7 bridges the inner opposite walls of the recessed switch housing 15 obliquely to the horizontal direction and a spring 5 is interposed between the inner bottom surface of the switch housing 15 and the bottom surface of the key stem 4.

In the second embodiment of the device for opening and closing the reed switch, when the key 13 is depressed only by the distance corresponding to the length of the leg of a right angle triangle formed with one of the reeds 10 or 11 as the hypotenuse, the reed switch 7 can be positively opened and closed. Except for this, the operation is almost the same as that of the first embodiment of the device. Accordingly, a detailed operational description will be omitted and the parts corresponding to those of the first embodiment are shown by corresponding reference numerals.

In the above first embodiment of the device for opening and closing the reed switch, the boundary line 6c of the magnet means 6 may be disposed horizontally and the reeds 10 and 11 of the reed switch 7 may be obliquely disposed with respect to the horizontal direction.

In the above second embodiment of the device for opening and closing the reed switch, the reeds 10 and 11 of the reed switch 7 may be disposed horizontally and the boundary line 6c of the magnet means 6 may be disposed obliquely to the horizontal direction.

In the above-mentioned two embodiments of the device according to the present invention, the angle of the reeds 10 and 11 of the reed switch 7 with respect to the N-S direction of the magnet means 6 may be adjusted and the positional relationship between the contact 9 of the reed swtich 7 and the boundary 6c of the magnet means 6 can also be adjusted to control the working distance or travel of the key 13 and the sensitivity of the magnetic force of the reeds 10 and 11 of the reed switch 7.

As is apparent from the foregoing description, since the reed switch opening and closing device of this invention has only one reed switch 7 composed of one simple permanent magnet having N and S poles, the device is very simple in construction. It also minimizes or eliminates unstable factors caused by mutual interference of lines of magnetic force unlike a conventional device using magnets of three or four poles. Further, the device of the present invention performs sensitive opening and closing operations with high accuracy.

According to the present invention, since the reed switch opening and closing device comprises magnet means 6 for effectively opening and closing the contact 9 of the reed switch 7 by only slightly moving the magnet means 6 upwardly and downwardly with the boundary line 6c between the N and S pole blocks of the magnet means as a center, the entire device can be made quite compact, and, since both reeds are placed in one magnetic force area in the opening operation, they are not influenced by the other magnetic force area and therefore their operations become even more accurate.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A reed switch opening and closing device comprising:

a reed switch having first and second reeds, the first and second reeds extending generally longitudinally along a first line, the first and second reeds being resiliently biassed so as not to contact each other unless the first reed is disposed in a magnetic field of a first polarity and the second reed is disposed in a magnetic field of a second polarity opposite to the first polarity;

a magnetic means having a first pole of the first polarity and a second pole of the second polarity, the first pole being joined to the second pole along a second line which is obliquely disposed with respect to the first line along which the first and second reeds generally longitudinally extend, the first pole generating a first magnetic field of the first polarity and the second pole generating a second magnetic field of the second magnetic polarity;

the reed switch having closed and open positions, the closed position occurring when the first reed is disposed within the first magnetic field and the second reed is disposed within the second magnetic field causing the first and second reeds to attract each other and to make contact with each other, the open position occurring when the first and second reeds are both disposed in the first magnetic field in order to overcome the peripheral influence of the second magnetic field to permit the first and second reeds to be resiliently biassed so as to not contact each other;

the switching from the closed position to the open position and from the open position to the closed position occurring with linear displacement of the second line with respect to the first line, the second line passing through the area in which the first and second reeds contact each other when in the closed position.

2. A reed switch opening and closing device in accordance with claim 1 wherein the first line intersects the second line at an angle of 10° - 80°.

3. A reed switch opening and closing device in accordance with claim 1 wherein the first line intersects the second line at an angle of substantially 45°.

4. A device according to claim 1 further comprising a keyboard having at least one switch chamber having a key stem of a key vertically slidably disposed in the switch chamber and a return spring interposed between the lower surface of the key top of the key and the upper surface of the keyboard.

5. A device according to claim 1 further comprising a recessed switch housing fixed to the upper surface of a keyboard through a flange formed at the upper edge of the switch housing, the reed switch bridging the inner opposite walls of the switch housing obliquely to the horizontal direction, a key with a key stem vertically slidably disposed in the switch housing, and a return spring interposed between the inner bottom surface of the switch housing and the bottom surface of the key stem.

* * * * *